US009340948B2

(12) United States Patent
Allen et al.

(10) Patent No.: US 9,340,948 B2
(45) Date of Patent: May 17, 2016

(54) EXPLOSION MITIGATING VAULT

(71) Applicant: EJ USA, Inc., East Jordan, MI (US)

(72) Inventors: James R. Allen, Bellaire, MI (US); Jeremy I. Johnson, East Jordan, MI (US); Kevin J. Wright, Charlevoix, MI (US); Dean W. Reynolds, Elmira, MI (US)

(73) Assignee: EJ USA, Inc., East Jordan, MI (US)

( * ) Notice: Subject to any disclaimer, the term of this patent is extended or adjusted under 35 U.S.C. 154(b) by 105 days.

(21) Appl. No.: 14/503,882

(22) Filed: Oct. 1, 2014

(65) Prior Publication Data

US 2016/0097181 A1 Apr. 7, 2016

(51) Int. Cl.
*E02D 29/14* (2006.01)

(52) U.S. Cl.
CPC ..... *E02D 29/1436* (2013.01); *E02D 29/14* (2013.01)

(58) Field of Classification Search
CPC ..... E02D 29/14; E02D 29/1436
USPC ..... 404/25, 26; 49/21; 137/371; 52/20
See application file for complete search history.

(56) References Cited

U.S. PATENT DOCUMENTS 13,352 A * 7/1855 Harrison, Jr. ..... E02D 29/1409 404/26
1,071,577 A * 8/1913 Rego ..... E05F 15/71 49/21
1,955,018 A 4/1934 Rego
1,988,360 A * 1/1935 Moore ..... F16J 13/08 220/327
1,992,354 A * 2/1935 Coleman ..... E02D 29/14 16/287
2,009,132 A 7/1935 Gehris
2,025,839 A * 12/1935 Woods, Jr. ..... E02D 29/14 404/25
3,712,009 A 1/1973 Campagna
4,761,319 A 8/1988 Kraus et al.
5,071,177 A * 12/1991 Spiess ..... E02D 29/1427 292/214
5,275,202 A * 1/1994 VanDeVyvere ..... F16K 17/10 137/492

(Continued)

FOREIGN PATENT DOCUMENTS

JP 56025524 A * 3/1981

OTHER PUBLICATIONS

EJIW Drawing for Product No. 00370402, dated Sep. 9, 2004.

(Continued)

*Primary Examiner* — Joshua J Michener
*Assistant Examiner* — Matthew Gitlin
(74) *Attorney, Agent, or Firm* — Warner Norcross & Judd LLP

(57) ABSTRACT

A controlled pressure release vault panel assembly is capable of functioning as a second, or auxiliary, relief port to allow the escape of fluid from the vault in the event of pressure build-up inside the vault or in an explosion event. The vault panel assembly may define an opening that includes a manhole cover assembly. The manhole cover assembly may also be vented, and may function as a primary vent. The vault panel assembly may include a retention assembly extending from the vault panel underneath a portion of the vault, enabling a limited range of motion of the vault panel for the escape of fluid and allowing the reseating of the vault pane on the vault once the pressure inside the vault approaches ambient pressures.

20 Claims, 6 Drawing Sheets

(56) References Cited

U.S. PATENT DOCUMENTS

| | | | | |
|---|---|---|---|---|
| 5,324,135 | A * | 6/1994 | Smith | E02D 29/1427 210/164 |
| 5,511,575 | A * | 4/1996 | Andenmatten | B60P 3/224 137/202 |
| 5,950,368 | A * | 9/1999 | Bradford | E02D 29/1418 220/484 |
| 6,350,081 | B1 | 2/2002 | Khajavi et al. | |
| 6,551,015 | B1 | 4/2003 | Khajavi et al. | |
| 7,484,908 | B2 | 2/2009 | Stadler | |
| 7,540,683 | B2 | 6/2009 | Salas | |
| 7,559,717 | B2 | 7/2009 | Salas | |
| 7,712,995 | B2 | 5/2010 | Stadler | |
| 7,891,904 | B2 | 2/2011 | Stadler | |
| 7,922,033 | B2 | 4/2011 | Kearby et al. | |
| 8,714,867 | B1 | 5/2014 | Vrondran et al. | |
| 8,784,000 | B2 | 7/2014 | Reynolds et al. | |
| 2008/0048460 | A1 * | 2/2008 | Brady | E02D 29/124 292/256.71 |
| 2009/0154993 | A1 * | 6/2009 | Stadler | E02D 29/1436 404/72 |
| 2013/0089373 | A1 | 4/2013 | Bax | |
| 2016/0053457 | A1 * | 2/2016 | Stadler | E02D 29/1427 404/25 |

OTHER PUBLICATIONS

EJIW Drawing for Product No. 00102015, last revised Jun. 10, 2008.
EJIW Drawing for Product No. 00115421, last revised Jul. 28, 2008.
EJIW Drawing for Product No. 00115411, last revised Oct. 10, 2008.
EJIW Drawing for Product No. 00148383, last revised Sep. 19, 2012.
EJIW Drawing for Product No. 00188879A01, last revised Apr. 1, 2013.
Insulated Conductor's Committee, Mitigating Manhole Events, Mar. 6, 2014.

* cited by examiner

EXPLOSION MITIGATING VAULT

BACKGROUND OF THE INVENTION

The present invention relates to explosion mitigation for access openings, and more particularly to a vault panel configured to release pressure during an explosion event.

Vaults generally are enclosures that may be located fully or partially below grade in or near a road, a walkway, or in a basement of a residential or commercial building. Such vaults may house electrical or other equipment that occasionally smoke or may catch fire and could cause an explosion within the vault. There are many examples of combustible gases to be found in subsurface structures that contain electrical equipment. Cable insulations are typically hydrocarbon based materials such as cross-linked polyethylene (XLPE), ethylene propylene rubber (EPR), polyethylene (PE) and polyvinyl chloride (PVC) that are flammable if they are vaporized and exist within their respective flammable limits. Transformers, voltage regulators and oil-filled switches that are often installed in vaults utilize dielectric fluids that are combustible when vaporized as a result of a damaging fault. Insulating oils employed in paper insulated lead covered (PILC) cables and in self-contained fluid-filled (SCFF) cables are combustible and can add chemical energy to an explosion event if they ignite during a failure.

Aging cables, splices, and joints that may have been overloaded in the past can emit combustible gases as insulation materials overheat and degrade. If these gases are emitted in sufficient quantities such that they reach their flammable limits, then gas explosions can occur in the presence of an ignition source. Other likely sources of combustible gases can be traced to salt or other chemicals that are applied to streets during winter months; gases present due to the public disposal of combustible materials in the streets; decaying organic material that finds its way into underground structures; and gases from leaks in pipelines.

Somewhat limited access to a vault may be by a removable vault panel. For example, one wall of the vault—generally the top wall—may have an opening for receiving a vault panel. The vault panel can be a removable panel over the access opening providing ingress/egress for the underground area. The panel may, among other things, prevent a person from falling in and can restrict entry of unauthorized persons. Such panels may be seated on a frame installed over the access opening and may be flush with an at-grade surface such as a road, walkway, or basement floor. The frame may provide an interface for the panel to seat over the opening within the vault wall. Generally, the panel is secured to the frame or surrounding structure so that the panel may be removed for access while the frame remains fixed in place.

The vault panels often weigh more than 100 pounds, partly because the weight keeps them in place when traffic passes over them, and partly because they are often made out of concrete, sometimes with steel or cast iron frames. This makes them inexpensive and strong, but heavy. Despite their substantial weight, explosions in the area underneath the panel may unseat the panel due to the sudden pressure build up from the explosion. In many cases, the explosion events may move the panel so that the access opening is left fully or partially uncovered. And, in some explosion events, the panel may become a projectile, flying up to 20 feet or more in the air. To address these potentially undesirable effects, vault panels are sometimes bolted or fastened to the frame. This configuration, however, may not fully or quickly relieve the pressure from an explosion event, thereby potentially causing structural damage to the underground area or to surrounding surface structure, such as the road or building.

In most cases where vaults are installed, the vault panels include a smaller opening within the panel that receives a manhole cover. The manhole cover may be the primary access point for the inside of the vault, with the vault panel forming a secondary access method for larger, heavier infrastructure that needs to be placed within the vault. These manhole covers are generally standard and well known; however, some manhole cover assemblies have been developed to release explosive pressure in a controlled fashion. These assemblies behave similar to a relief valve by allowing the manhole cover to rise in response to explosive pressure and to then reseat once the pressure has subsided. In this way, the manhole cover may be prevented from becoming a projectile, or from leaving the frame or access opening uncovered, in response to an explosive event.

SUMMARY OF THE INVENTION

The present invention provides a vault panel assembly that enables controlled pressure release vault panel configured to function as a relief valve in an explosion event. The vault panel can be unseated from a vault panel receiving surface in the vault wall to allow fluid such as air or explosive gas, to vent from the vault while the vault panel is prevented from becoming completely removed from the vault. The vault panel assembly may be a secondary pressure relief feature that includes a manhole cover with a frame positioned within the vault panel assembly to act as a primary pressure relief feature. Both the manhole cover and vault panel thereby allowing pressure to release from the underground area through one or both of the access opening and a vault opening.

In one embodiment, for example, the controlled pressure relief vault panel may include a vault panel inner surface, an outer surface opposing said inner surface, and a vault panel peripheral edge. At least one projection may extend from the vault panel with one end fixed to the vault panel inner surface and another end with a stop defining a length of the projection. At least a portion of the stop may extend into the vault such that, in response to increased pressure, the vault panel has a range of movement outwardly from the vault to allow the escape of fluids through the vault opening. The range of movement for the panel may be defined by characteristics of the stop. The vault panel assembly may also include an access opening to the vault which may define a cover frame, and a manhole cover also adapted to move from a seated position to an unseated position with respect to said cover frame.

In one embodiment, the stop may include at least one retainer leg and a spring associated with the projection. In an active position, the retainer leg may extend radially past the peripheral edge of the vault panel so that, in response to increased pressure inside the vault, the vault panel has a range of vertical movement outwardly from the vault to allow the escape of fluids though the vault opening with the retained leg defining a limit of the range of motion.

In a further embodiment, the spring may be a coil spring a radially surrounding a portion of the projection and positioned on the projection between the retaining leg and a bushing at or near the second or distal end of the projection.

In another embodiment, the stop may include a leaf spring with two ends. the ends of the leaf spring may extend radially past the peripheral edge of the vault panel and inside the vault such that, in response to an increase in pressure within the vault, the vault panel has a range of vertical movement outwardly from the vault to allow the escape of fluids through the vault opening with the leaf spring defining a limit of the range of movement.

In any of the foregoing embodiments, the manhole cover may move from its seated position to its unseated position to vent fluid from the vault in response to a first threshold level of pressure inside the vault. The vault panel may then form a secondary pressure release, such that it moves from a seated to an unseated position in response to a second, higher, threshold level of pressure inside the vault.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENT

I. Overview

Figure 1:
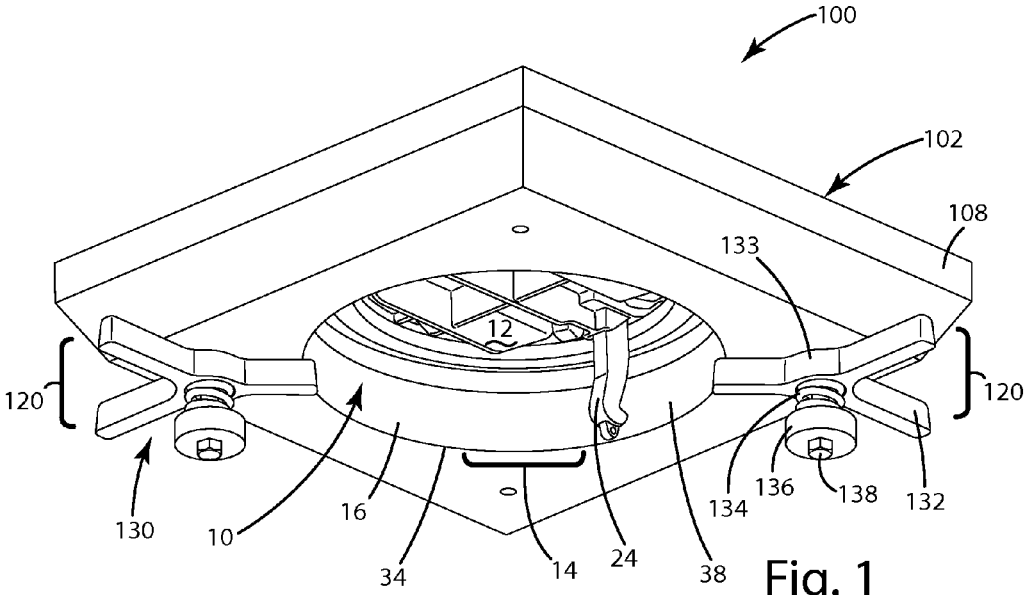
FIG. 1 is a bottom perspective view of a vault panel assembly according to a current embodiment.

Referring to FIGS. 1-6, the numeral 100 generally designates a vault panel assembly. As will be more fully described below, the vault panel assembly may include features that allow movement of a vault panel 102 from a seated to an unseated position relative to a vault opening in order to allow the escape of fluid when excess pressure builds inside the vault. The venting of fluid is allowed while retaining the vault panel 102 to the vault to prevent the vault panel 102 from being completely removed from the vault and to allow the panel to return to a seated position when the excess pressure subsides. As will be more fully described below, the vault panel assembly 100 may include projections with retention elements that can provide venting properties to the vault by allowing the escape of fluid from a vault upon an increase of pressure in the vault and facilitate the return of the panel assembly to its seated position.

II. Vault Panel Assembly

Referring again to FIGS. 1-2 and 4-6, a controlled pressure relief vault panel is shown as a vault panel assembly 100, and may include a vault panel 102 with an inner surface 104, an outer surface 106 opposite the inner surface 104, and a peripheral edge 108. The vault panel 102 is capable of being seated in a vault opening 112 in vault wall 110 to cover the vault opening and to function as a pressure release mechanism in the event that excess pressure builds in the vault 111. The vault opening 112 in the vault wall 110 may be provided with vault panel receiving surface 114 that may be shaped to complement a profile of the peripheral edge 108 of vault panel 102 to allow the vault panel 102 to be seated in the vault opening 112.

As described in more detail below, the vault panel 102 may include an access cover assembly 10, such as a controlled pressure release cover 10. The cover assembly 10 may be secured to the vault panel 102, for example, by embedding a base flange 35 of a frame 14 in the vault panel 102. The cover assembly 10 covers an access opening 15 defined within the vault panel 102. Together, the cover assembly 10 and the vault panel assembly 100 may each function as pressure relief valves in the event of excessive pressure build up in the vault 111 such as may occur during an explosion. The cover assembly 10 and the vault panel assembly 100 may provide staged relief by providing a first pressure relief response at a lower threshold of pressure increase within the vault 111 and a second pressure relief response at a higher threshold of pressure increase within the vault 111. In this way, the vault panel 102 may act as a secondary or auxiliary vent for the vault 111 during an explosion event that requires such additional venting of fluid. The lower threshold pressure increase is indicated by arrows 150 such as those in FIG. 5 and may be related to the weight of the cover 12. The higher threshold pressure increase is indicated by arrows 160 such as those in FIG. 6 and may be related to the weight of the cover 12 and/or the vault panel assembly 100. For example, the cover 12 of the cover assembly 10 may open relative to the frame 14 upon the meeting of the lower threshold of increased pressure and the vault panel 102 of the vault assembly 100 may open relative to the vault wall 110 upon the meeting of the higher threshold of increased pressure. Additionally, or alternatively, one or both of the cover 12 and the vault panel 102 may open in a single action with an increase in pressure inside the vault that would trigger the movement of both the cover 12 and the vault panel 102 at the same time.

The inner surface 104 of the vault panel 102 may be fit with retention elements 120 to limit the vertical movement of the vault panel 102 with respect to the vault wall 110 and to facilitate the return of the vault panel 102 to a seated position when the pressure inside the vault 111 approaches equalization with ambient pressures. The retention elements 120 may include a projection 122 with one end 124 embedded in the vault panel 102, or attached to the inner surface 104 of the vault panel 102. A second end 126 of the projection 122 may extend from the inner surface 104 of the vault panel 102. The second end 126 of the projection 122 may define a distal end of the projection 122. In one embodiment, a leg assembly 130 may be affixed to, or otherwise associated with, the distal end of the projection 122. The leg assembly 130 may include one or more retainer legs 132. For example, the leg assembly 130 of FIG. 3 includes three retainer legs 132 arranged in a Y-shape with a common body portion 133 fitted radially on the projection 122. The retainer legs 132 can be capable of rotation between an installation position and an active position. In the installation position, the retainer legs 132 are rotated such that they will not interfere with the profile of the peripheral edge 108 of the vault panel 102 fitting into its complementary vault panel receiving surface 114. In an active position, one or more of the retainer legs 132 can be rotated to radially extend from the projection 122 and extend at least partially inside the vault 111 and at least partially underneath the vault wall 110.

Further, a spring may be associated with the projection 122 and retainer legs 132. As shown in FIGS. 1-6, the spring 134 may be a coil spring radially surrounding the projection 122 with a bushing 136 and nut 138 located distally of the spring 134 so that the spring 134 is between the bushing 136 and the body portion 133 of the Y-shaped portion of the leg assembly 130. The nut 138 may be removably fixed to the second, or distal, end 126 of the projection 122. While the leg assembly 130 is shown in FIG. 3 as having 3 retainer legs 132, it should be understood that the leg assembly 130 may include any number of legs 132.

Figure 4:
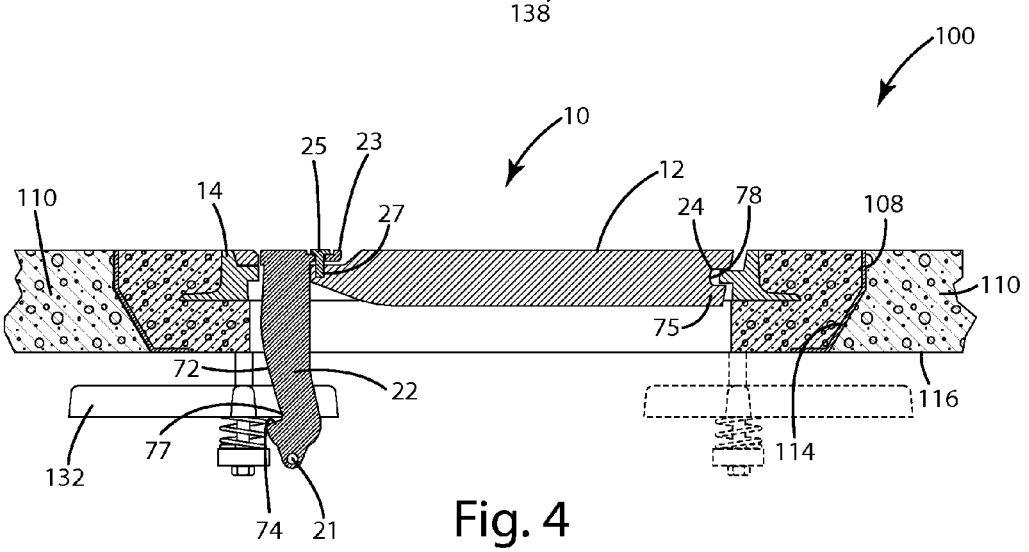
FIG. 4 is a cross sectional view along Section A-A in FIG. 2, of a vault panel in a seated position with an access cover in a seated position.
Figure 5:
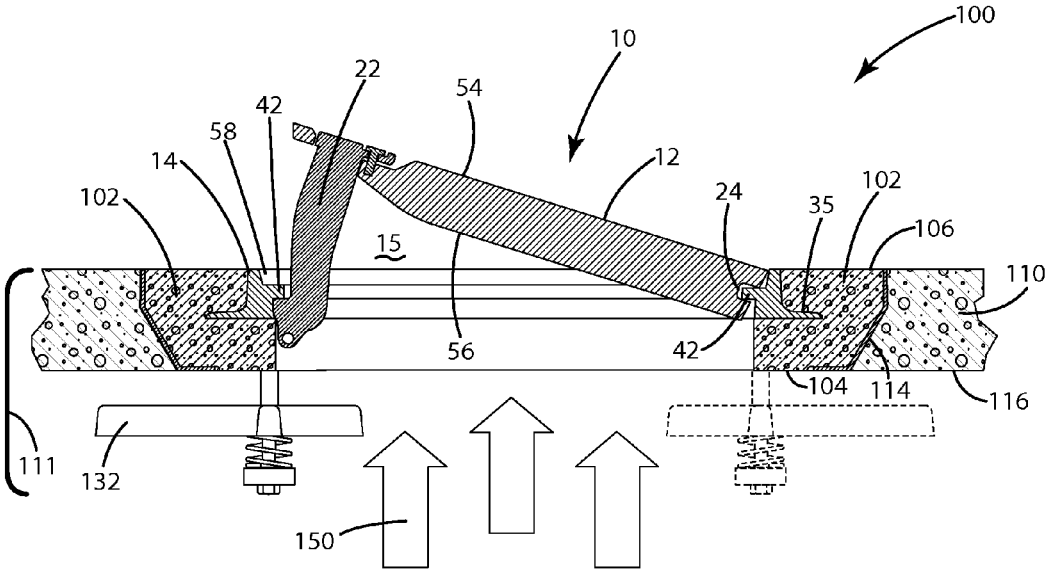
FIG. 5 is a cross sectional view along Section A-A in FIG. 2 of a vault panel in a seated position and an access cover in an unseated position.
Figure 6:
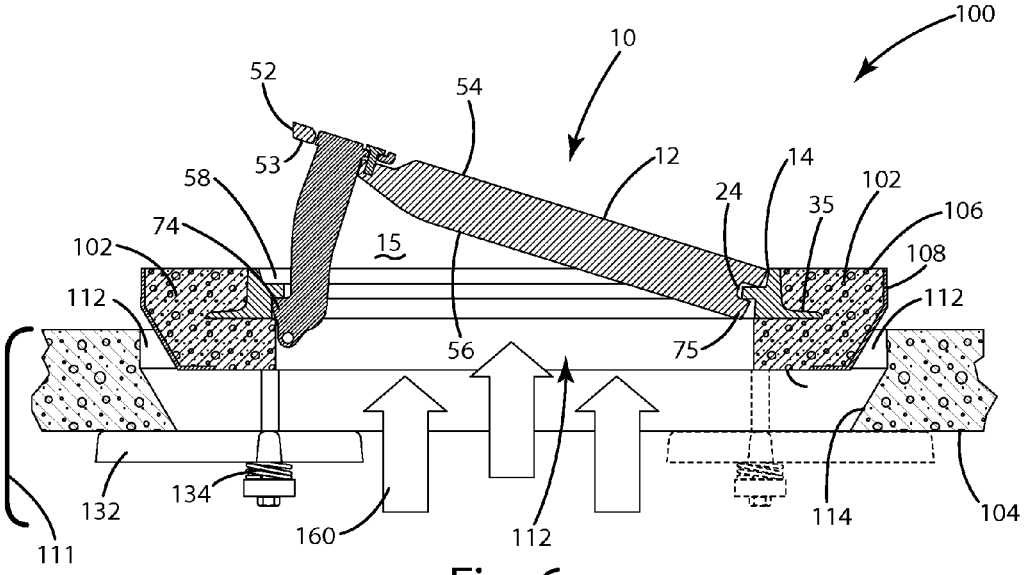
FIG. 6 is a cross sectional view along Section A-A in FIG. 2 of a vault panel in an unseated position and an access panel in an unseated position.
Figure 7:
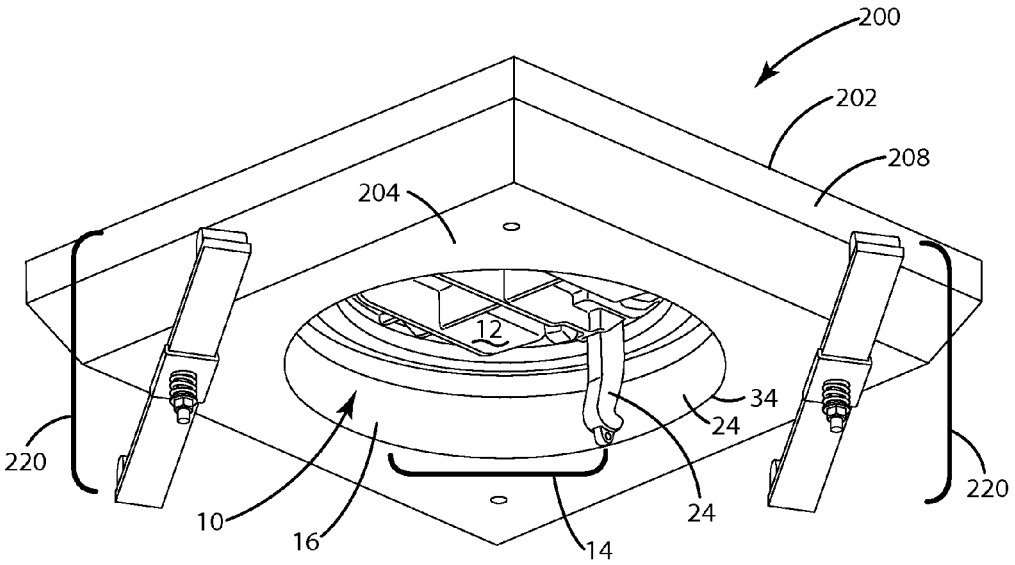
FIG. 7 is a bottom perspective view of a vault panel assembly according to a current embodiment.
Figure 8:
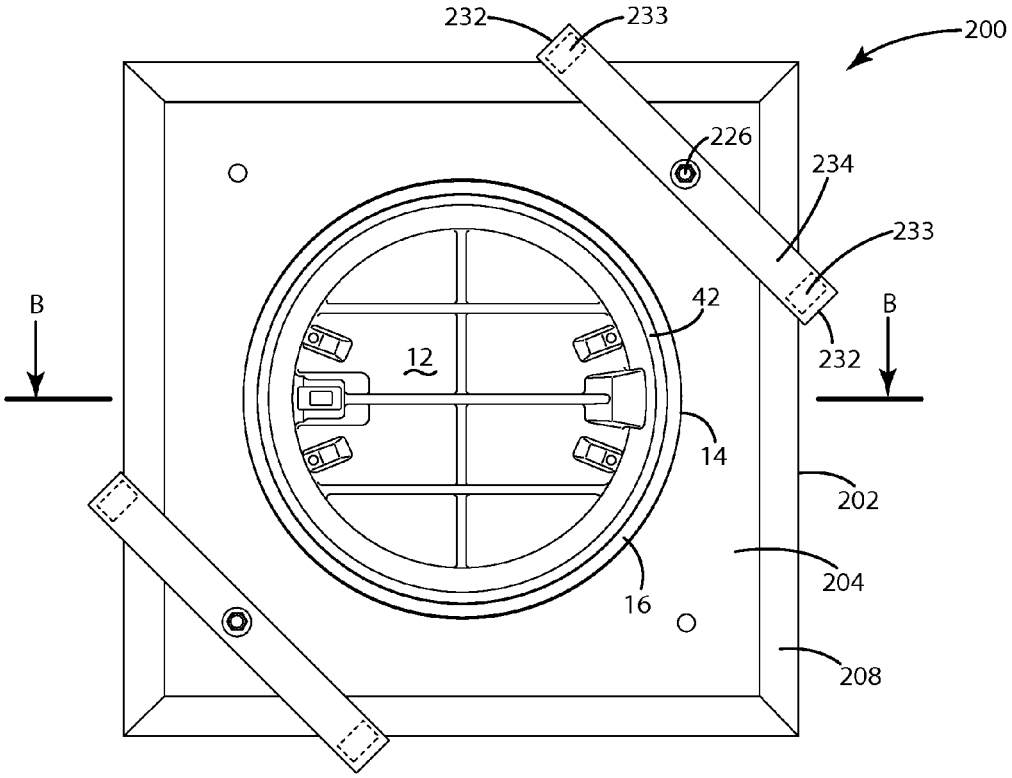
FIG. 8 is a bottom view of the vault panel assembly shown in FIG. 7.

As shown in FIGS. 4 and 5, the vault panel 102 is in a seated position with the peripheral edge 108 of the vault panel 102 resting in the vault panel receiving surface 114 in the vault wall 110. In this position, the retention legs 132 are spaced vertically apart from an internal surface 116 of the vault wall 110. The spring 134 may be relaxed or minimally compress by the weight of the retention elements 120 including the legs 132. The projection 122 may be maximally extended under the vault opening 112. The vault panel 102 may remain in the seated position whether the cover 12 (discussed in more detail below) is in the seated position, as shown in FIG. 4, or in the unseated position, as shown in FIG. 5. Referring now to FIG. 6, in the unseated position of the vault panel 102, the peripheral wall 108 of the vault panel 102 may separate from the vault panel receiving surface 114. This separation of the vault panel 102 from the vault panel receiving surface 114 may be in the vertical direction. The retention legs may contact the inner surface 116 of the vault wall 110 to prevent the detachment of the vault panel 102 from the vault 111 and to set a limit on the range of motion of the vault panel. The spring 134 may be compressed due to the vertical movement of the projection 122 with the vault panel 102 and the retention leg 132 contact with the inner surface 116 of the vault wall 110. The compression of the spring 134 may provide a buffer or cushion allowing for an additional degree of control over the venting provided by the unseating of the vault panel 102 and the reseating of the vault panel 102 into the vault panel receiving surface 114 once the pressure subsides. The compressing of the spring 134 may be aided by the bushing 136 and nut 138 at the proximal end 126 of the projection 122. The vertical movement of the vault panel 102 relative to the vault panel receiving surface 114 may be related to, or controlled by, the particular characteristics of the leg assembly 130 such as the spring characteristics, such as length and spring constant, and may also be related to, or controlled by the length of the projection 122.

Variations of the vault panel assembly may also be effective for allowing the seating and unseating of the vault panel with pressure changes inside the vault. Reference numerals in FIGS. 7-12 correspond to the reference numerals of FIGS. 1-6 except that they are denoted in a 200 series, respective to FIGS. 7-12. One such variation is shown in FIGS. 7-8 and 10-12, wherein the controlled pressure relief vault panel is shown as a vault panel assembly 200 with a vault panel 202 having an inner surface 204, an outer surface 206 opposite the inner surface 204, and a peripheral edge 208. The vault panel 202 is capable of being seated in a vault wall 210. The vault panel receiving surface 214 may be provided in the vault opening 212 in the vault wall 210.

Once again, the vault panel 202 may include an access cover assembly such as the assembly 10 described below. The cover assembly 10 may be secured to the vault panel 202, for example, by the same means described herein with respect to the vault panel assembly 100. As with vault panel assembly 100, the cover assembly 10 and the vault panel assembly 200 may provide staged relief by providing a first pressure relief response at a lower threshold of pressure increase within the vault 211 and a second pressure relief response at a higher threshold of pressure increase within the vault 211. Additionally, or alternatively, one or both of the cover 12 and the vault panel 202 may open in a single action with an increase in pressure inside the vault that would trigger the movement of both the cover 12 and the vault panel 202 at the same time.

Figure 9:
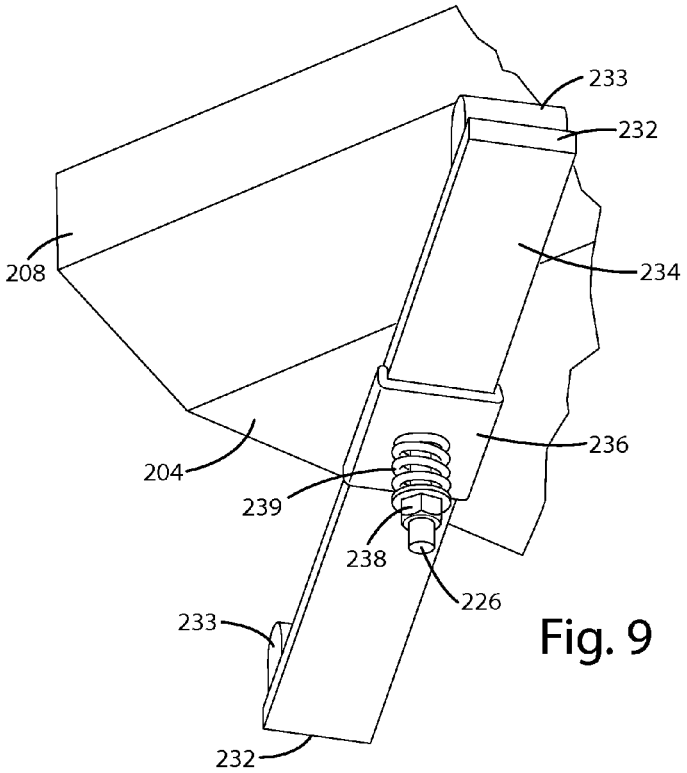
FIG. 9 is a detailed view of a spring of the vault panel assembly shown in FIGS. 7-8.

The inner surface 204 of the vault panel 202 may be fit with retention elements 220 to limit the vertical movement of the vault panel 202 with respect to the vault wall 210 and to facilitate the return of the vault panel 202 to a seated position when the pressure inside the vault 211 approaches equalization with ambient pressures. In the embodiment shown in FIGS. 7-8 and 10-12, the retention elements 220 include a projection 222 with one end 224 embedded in the vault panel 202, or attached to the inner surface 204 of the vault panel 202. In another embodiment, the projection 222 may be inserted through a preexisting hole in the vault panel 202, for example, a predrilled hole intended for use in affixing the vault panel 202 to lifting equipment for insertion and removal of the vault panel 202. A second end 226 of the projection 222 may extend from the inner surface 204 of the vault panel 202. The second end 226 of the projection 222 defines a distal end of the projection 222. Retention elements 220 may be affixed to, or otherwise associated with, the distal end of projection 222. The retention elements 220 230, as shown in FIG. 9, may include a spring 234, such as a leaf spring, with two opposing ends 232. The leaf spring may be shaped with a pre-formed curve. The retention elements 220 of FIG. 9 include a flat spring 234 with retention spacers 233 at either end. The spring 234 may be attached to the projection 222 by providing a hole between the ends 232 of the spring 234. The hole may be positioned midway between the opposing ends 232 or may be placed closer to one end or the other. The spring 234 may be secured on the projection 222 by a bracket 236 and nut 238 and may include a spring 239, such as a coil spring as shown or an alternative spring such as a rubber spring between the bracket 236 and nut 238. Alternatively, a bushing, or a combination of a spring and bushing, may be inserted between the bracket 236 and nut 238. The ends 232 of the spring 234 extend from the projection 222 and extend at least partially inside the vault 211 and at least partially underneath the vault wall 210.

Figure 10:
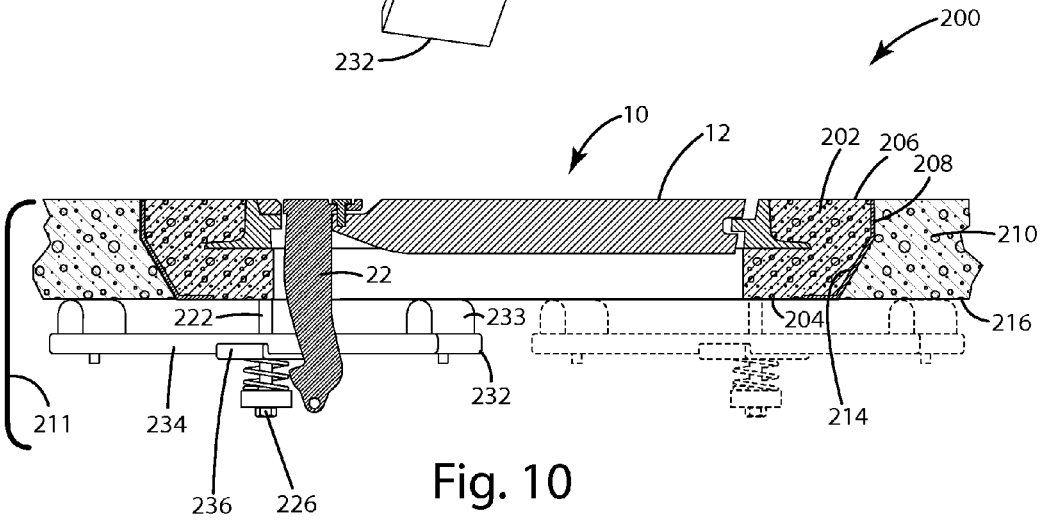
FIG. 10 is a cross sectional view along Section B-B in FIG. 8 of a vault panel in a seated position with an access cover in a seated position.
Figure 11:
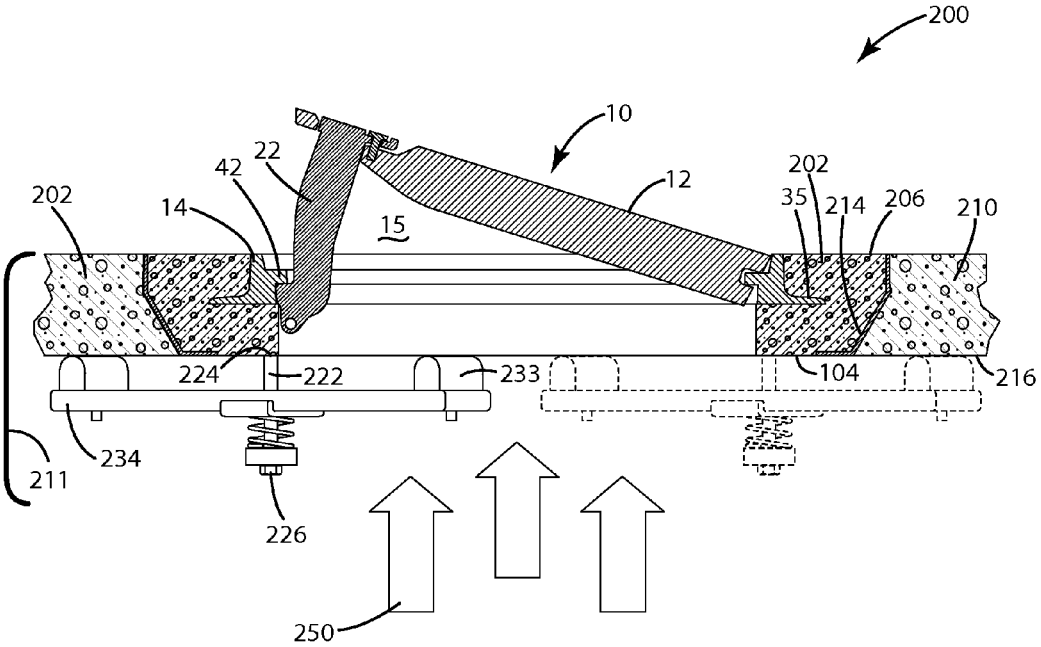
FIG. 11 is a cross sectional view along Section B-B in FIG. 8 of a vault panel in a seated position with an access cover in an unseated position.
Figure 12:
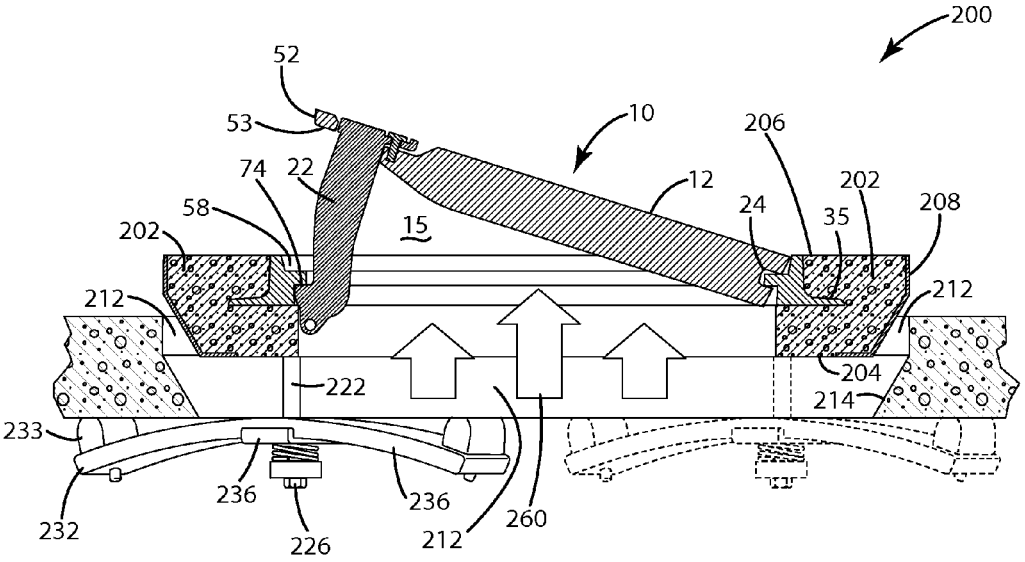
FIG. 12 is a cross sectional view along Section B-B in FIG. 8 of a vault panel in an unseated position and an access cover in an unseated position.

As shown in FIGS. 10 and 11, the vault panel 202 is in a seated position with the peripheral edge 208 of the vault panel 202 resting in the vault panel receiving surface 214 in the vault wall 210. In this position, the ends 232 of the spring 234 may contact an internal surface 216 of the vault wall 210, and the spring 234 may be relaxed. The projection 222 may be extended under the vault opening 212. The vault panel 202 may remain in the seated position whether the cover 12 is in the seated position, as shown in FIG. 10, or in the unseated position, as shown in FIG. 11. Referring now to FIG. 12, in the unseated position of the vault panel 202, the peripheral wall 208 of the vault panel 202 may separate from the vault panel receiving surface 214. This separation of the vault panel 202 from the vault panel receiving surface 214 may be in the vertical direction. The spring 234 may be compressed due to the vertical movement of the projection 222 with the vault panel 202 and the contact of the tension spacer 233 with the inner surface 216 of the vault wall 210. The compression of the spring 234 may provide a buffer or cushion allowing for a degree of control over the venting provided by the unseating of the vault panel 202 and the reseating of the vault panel 202 into the vault panel receiving surface 214 once the pressure subsides. The compressing of the spring 234, and the degree of control, may be aided by the spring 239, if present.

The retention elements 120, 220 shown in the FIGs include these elements arranged at or near diametrically opposite areas of the panel 102, 202. Alternatively, these elements may be spaced in different locations, and the panel assembly 100, 200 may include any number of such elements to aid retaining and reseating the panel 102, 202.

III. Access Cover Assembly

As noted, the vault panel assembly 100 may optionally include an access cover assembly (or "manhole cover assembly") generally designated 10 positioned within the vault panel 102. In one embodiment, the cover assembly 10 generally includes an access cover 12 and frame 14 adapted to support the cover 12. The frame 14 defines an access opening within the vault panel 102. In one embodiment, the cover is a "standard" manhole cover that fits in the frame 14 to cover the access opening. In another embodiment, the cover 12 is configured to behave as a relief valve in an explosion event, opening so that fluid, such as air, explosive gas, or another gas, may vent through the cover assembly 10. The cover 12 is configured to limit its movement with respect to the frame 14 in response to increased pressure on the cover 12 and to then return to a seated position once the pressure has subsided. Referring for example to the embodiment shown in FIGS. 1-2 and 4-6, the cover 12 generally includes the frame 14 adapted to support the cover 12. Upon the pressure under the cover 12 reaching a threshold, the cover 12 lifts angularly with respect to the frame 14. The cover assembly 10 is configured to limit the movement of the cover 12 with respect to the frame 14 in response to increased pressure on the cover 12 and to then return the opened portion of the cover 12 to a seated position once the pressure has subsided. Referring to FIGS. 4-6, the cover assembly 10 includes legs 22 and 24 that, when in a locked position (e.g., a restraint mode), may engage the frame 14 to limit displacement of the cover 12 with respect to the frame 14. The leg 22 may be longer than the leg 24, causing the cover 12 to displace angularly. For example, as shown in FIGS. 5-6, the cover 12 is fully open with the legs 22 and 24 engaged with the frame 14, preventing further angular displacement of the cover 12 about an axis that generally extends through the support flange of the frame 14, about which the leg 24 rotates. This position allows fluid to flow through the access opening 15 and directs such flow in a particular direction defined by the positioning of the leg 22. And, as show in FIG. 4, the cover 12 is fully closed or seated with the leg 22 disengaged from the frame 14.

The legs 22 and 24 may be configurable from the restraint mode to a removal mode, in which one or more of the legs 22, 24 are adapted to pivot, release, or a combination thereof, in order to clear the frame 14 and enable removal of the cover 12 from the frame 14. Further, in the removal mode, one or more legs 22, 24 may also slide partially through an opening 58 in the cover 12, allowing the one or more legs to be used as a handle for removing the cover 12 from the frame 14.

Figure 2:
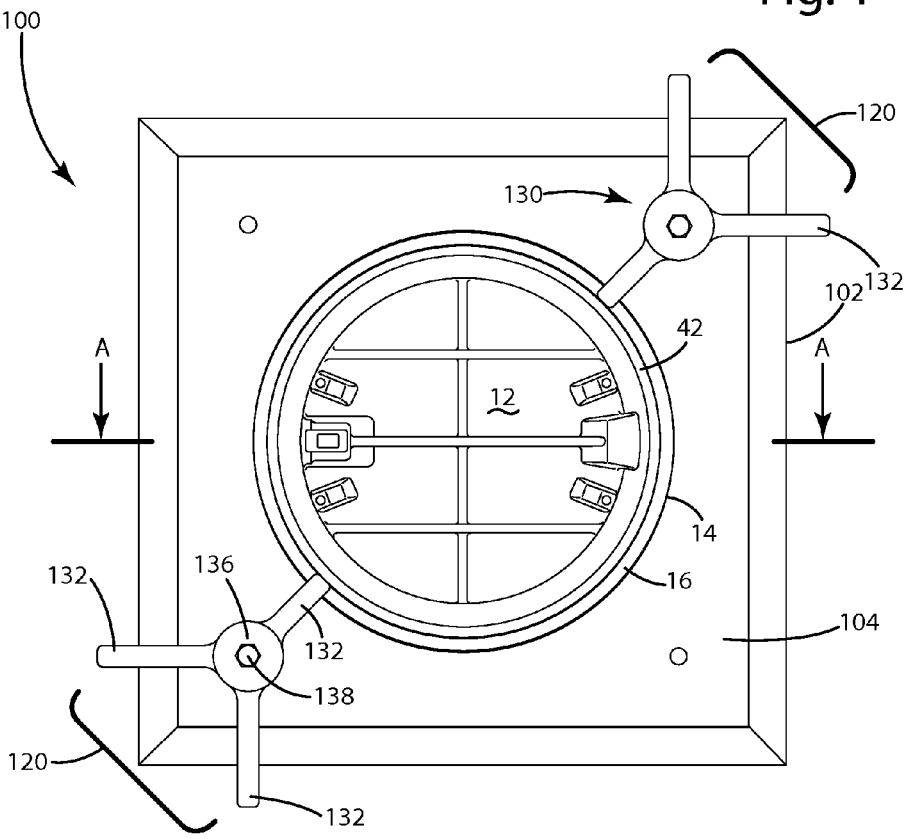
FIG. 2 is a bottom view of the vault panel assembly shown in FIG. 1.
Figure 3:
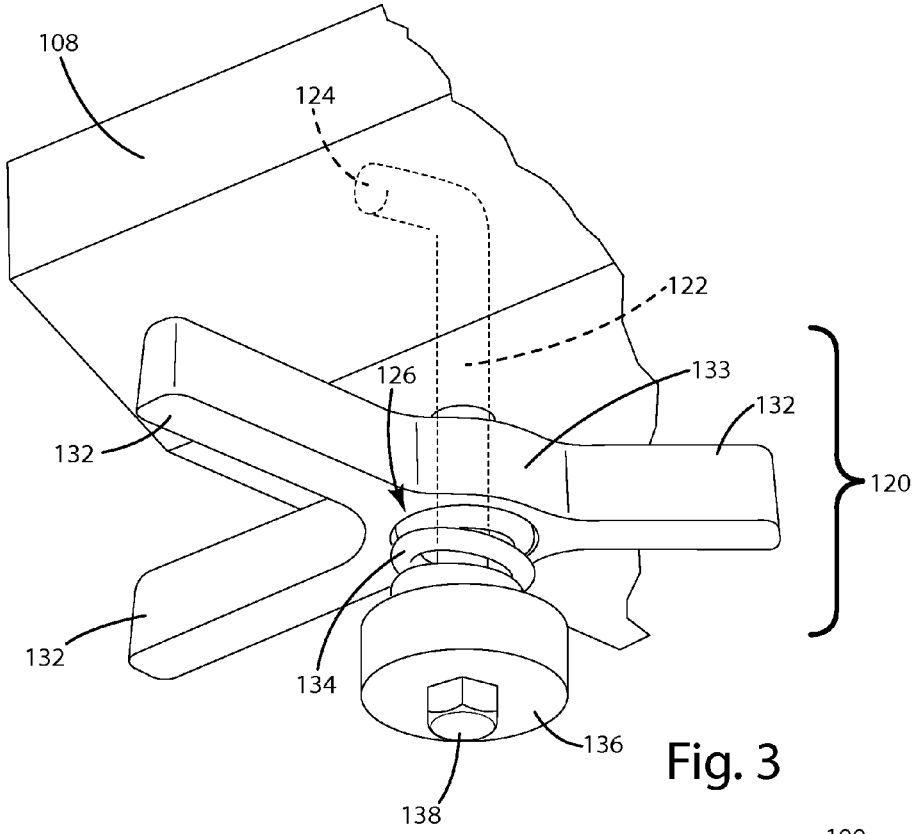
FIG. 3 is a detailed view of a projection and retention assembly of the vault panel assembly shown in FIGS. 1-2.

With reference to FIGS. 1-2, the frame 14 includes a base 34, and a peripheral wall 16 extending upwardly from the base 34 including an inner surface 38 and an outer surface 40. The inner surface 38 of the illustrated embodiment may include a cover receiving support flange 42 configured as an inwardly extending flange to support the cover 12 in a seated position with the underside of the cover 12 resting on the support flange 42. Although the described frame 14 is annular and may be installed over an access port to a manhole, vault or utility box (not shown), it should be appreciated that the frame 14 may be any shape, including rectangular or square. The configuration may be selected to interface with the cover 12 to cover the access opening. Alternatively, a supporting surface other than the cover receiving support flange 42, such as the top edge of the frame 14, may support the cover 12 in a seated position to cover the opening 15 (FIG. 6). The frame 14 as described is for illustrative purposes only as the cover 12 may be designed to retrofit onto many different types of frames 14 to convert those cover assemblies into explosion mitigation assemblies.

In the illustrated embodiment, the cover 12 is generally has a round shape to match the generally annular shape of the frame 14 and peripheral wall 16. Alternatively, the cover 12 may have a different shape to cover a variety of differently sized access openings and to interfit with a variety of differently sized frames 14. The cover 12 includes a peripheral edge 52, an upper surface 54 and an underside 56. The underside 56 may include a seating surface 53 adjacent to the peripheral edge 52 that interfaces with a supporting surface of the frame 14, such as the cover receiving support 42, in a seated position.

The cover assembly 10 includes a pair of legs 22, 24. Optionally, the legs 22, 24 may be configurable between two modes: a removal mode and a restraint mode. As shown in the illustrated embodiment of FIGS. 4-6, the legs 22, 24 are configured in the restraint mode such that movement of the cover 12 with respect to the frame 14 may be limited. For example, the cover 12 may move from a seated position as shown in FIG. 4 to an unseated position as shown in FIGS. 5-6. The cover 12 may be configured in a removal mode, enabling the cover 12 to be removed from the frame 14.

Each of the legs 22, 24 includes a foot 74, 75 respectively. The feet may be integrally cast as part of each leg during manufacture. The feet 74, 75 may extend radially outwardly toward the peripheral edge 52 of the cover 12, and each may include a frame-stop surface 77, 78 that may be configured to contact the frame 14 in order to limit displacement of the cover 12 with respect to the frame 14. The feet 74, 75 may project radially outwardly beyond the peripheral edge 52 of the cover 12 in order to be aligned underneath the frame 14. The feet 74, 75 are thus aligned vertically underneath the frame 14, at least when the cover 12 is in the restraint mode. For example, the feet 74, 75 may contact the underside of the frame supporting surface 42 limiting movement of the cover 12 in an explosion event. In one embodiment at least one of the legs 22 may include an angled guide surface 72; however, the angled guide surface of the leg 22 may be provided with a generally curved, convex shape. This shape may aid in holding the cover 12 tightly against the frame 14, particularly in the area of the second leg 24, as the cover 12 moves through an angular range of motion.

The leg 22 can be fixedly anchored to the cover 12 in the restraint mode while being slidably coupled to the cover 12 in the removal mode. This leg thus determines whether or not the cover 12 is in the restraint mode or the removal mode. The longer leg, or control leg 22 may include a projection 23, or lug, having a hole 25 capable of being fastened with an anchor bolt 27 to the cover 12 so that the control leg 22 is fixedly anchored to the cover 12. This fastens the leg 22 to the cover 12 and prevents the unwanted movement of the leg 22. However, it should be understood that the control leg 22 need not be fixedly anchored to the cover 12 in order to limit movement of the cover 12 with respect to the frame 14 in response to increased pressure. If the anchor bolt 27 or a fastener for the control leg 22 is misplaced, damaged or defective, the cover 12 and the control leg 22 may remain inherently capable of limiting movement of the cover 12. In other words, without the control leg 22 fixedly anchored to the cover 12, the cover 12 may be in the removal mode but still configured for limited movement during an explosion event. For instance, if the anchor bolt 27 is not present, the projection 23 may interface with the cover 12 to enable the cover 12 to behave as a relief valve.

The leg 22 may be inserted through a control leg anchor opening 58 defined in the cover 12 from the upper surface 54 to the underside 56. When the control leg is not secured to the cover 12 (i.e., in the removal mode) the control leg 22 may slide within this opening 58 so that the control leg 22 can be slid up and away from the frame 14, thereby enabling removal of the cover 12 from the frame 14. The leg 22 can move vertically, such that the upper end of the leg including the lug 23 extends out of the upper surface 54 of the cover 12, as well as pivotally, wherein the foot 74 moves radially inwardly so that it is no longer aligned vertically underneath the frame 14. For example, by using the projection 23 as a handle to pull the cover 12 from the frame 14, the second leg 24 may rotate about the frame 14 to a position in which the cover 12 may be free from the frame 14 so that it can be removed. The control leg 22 may include a pin 21 that prevents the control leg 22 from sliding completely through the opening 58 in the removal mode. This pin 21 may be installed during manufacture after the control leg 22 is inserted through the opening 58.

As shown in FIGS. 4-6, the second leg 24 is spaced from the control leg 22 and also shorter in length than the control leg 22. In the illustrated embodiment, the second leg 24 is positioned diametrically opposite the control leg 22. Alternatively, the second leg 24 may be spaced in a different location, and the cover 12 may include multiple second legs 24 to aid retaining the cover 12. The portion of the cover 12 proximate the longer control leg 22 is capable of a range of movement determined by the length of the control leg 22, which in the illustrated embodiment may be 8". This portion of the cover thus is capable of clearing the frame 14—with the underside 56 of the cover 12 above the upper edge of the frame 14. The portion of the cover 12 proximate the shorter second leg 24 has a smaller range of movement than the portion near the loner or control leg 22. In the illustrated embodiment, the length of the second leg 24 is controlled such that the foot 75 of the second leg 24 contacts the frame 14 when the cover 12 is closed. More particularly, as shown in FIG. 12, the foot 75 may include a curved contact surface 78, such that a distal portion 79 contacts the frame 14 when the cover is closed. This configuration enables the portion of the cover 12 near the second leg 24 to rotate about the frame mount flange 42, which extends between the foot 75 and the underside 56 of the cover 12. The curved surface 78 may provide clearance that enables such rotation. In this configuration, the portion of the cover 12 proximate the second leg 24 undergoes essentially no vertical movement when that portion is displaced, and the portion of the cover 12 proximate the second leg 24 does not clear the frame 14. In an alternative embodiment, the second leg 24 may be longer than that shown in the illustrated embodiment, for example, to interfit with a different frame 14 that may have a wider support flange 42, or to provide some degree of vertical displacement for the second leg 24 and the portion of the cover 12 proximate thereto.

The angular displacement of the cover 12 can be advantageous in that it limits the direction in which exiting fluids can flow. Instead of allowing fluids to escape through a 360 degree range, the angular displacement of the cover reduces the circumferential range that exiting fluids can flow. In addition, it is possible to orient the cover 12 during installation to direct any gases or flames that may exit the cover assembly 10 during an explosion event. For example, in an arrangement wherein a cover assembly 10 is installed on a sidewalk near a building, the cover 12 may be keyed, for example, by cooperating structure on the frame and cover, such that the longer leg 22 must face the building, such that when the cover 12 is displaced angularly upon the pressure under the cover reaching a threshold, escaping gases, fluids and flames will be directed toward the building rather than toward the open sidewalk.

In operation, the cover 12 may be configured between two modes: a restraint mode and a removal mode. In the restraint mode, the cover 12 may behave as a relief valve, displacing angularly in response to a pressure on the underside 56 exceeding a threshold and enabling fluid to vent through the access opening 15. The cover 12 may return to a seated position on the frame 14 after the pressure has subsided. In this way, if an explosion event occurs, damage to the cover assembly 10 and surrounding structure, such as the road or the underground area, may be prevented or mitigated. The pressure threshold resulting in displacement of the cover 12 may vary from application to application, generally depending on the weight of the cover 12, and to the extent there are other fluid paths from the underground area.

To place the cover 12 in the restraint mode, the second leg 24 may be placed within the access opening 15 and interfitted with the frame 14 such that the foot 75 extends underneath a portion of the frame 14. Next, the control leg 22 may slide within the control leg anchor opening 58 until the projection 23 of the control leg 22 contacts the upper surface 54 of the cover 12. An anchor bolt 27 may fasten the control leg 22 to the cover 12 so that the control leg 22 is stationary. It should be appreciated that fastening systems other than an anchor bolt 27 may be used to anchor the control leg 22 to the cover 12, and that the present invention is not limited to using an anchor bolt 27. Further, in one embodiment, the anchor bolt 27 or other fastener may be configured to be tamper resistant so that the cover 12 may be considered an unauthorized access deterrent. As an example, in embodiments in which the anchor bolt 27 is a bolt, the bolt may be a penta-head bolt or another bolt type capable of deterring unauthorized access.

With the cover in the restraint mode, the cover 12 may have a limited range of movement with respect to the frame 14 such that it may behave as a relief valve. The cover 12, however, may not be removed completely from the frame 14 without being reconfigured into the removal mode. For example, the feet 74, 75 may be aligned underneath the frame 14 and thus interfere with a portion of the frame 14 preventing vertical movement of the cover 12 beyond a certain point with respect to the frame 14. A portion of the peripheral wall 16 of frame 14, such as a flange, may be circular, and the feet 74, 75 may be arranged such that a circle circumscribed about the feet 74, 75 has a diameter larger than an inner diameter of the peripheral wall 16. A circle circumscribed about the angled-guide surfaces 71, 72, however, may have a diameter less than that of the peripheral wall 16.

Removal of the cover 12 may be enabled by configuring the cover into the removal mode. In this mode, any fastener holding the control leg 22 in place may be loosened or removed so that the control leg 22 may clear the frame 14. The cover may be pivoted open until the second leg 24 is capable of clearing the frame 14. With the legs 22, 24 in this configuration, the cover 12 may be removed from the frame 14 in order to access the manhole, vault, utility box, or other underground area.

IV. Operation

In operation, the vault panel assembly 100 may be configured between two modes: an installation/removal mode and a restraint mode. In the installation/removal mode, the vault panel assembly 100 may be installed and/or removed, as desired, from the vault 111 by positioning the retention elements 120 such that its components will not interfere with the placement of the vault panel 102 on the vault opening 112 and on the vault panel receiving surface 114. Once the panel assembly 100 is seated on the vault panel receiving surface 114, the legs 132 of the retention elements 120 may be rotated such that the assembly 100 is in a restraint mode. Access to the retention elements 120 may be gained by reaching through the access opening 15 of the cover assembly 10, or by other means. The vault panel 200 is positioned into a restraint mode by attaching the retention elements 220 of the springs 234 to the vault panel after the vault panel 202 is seated in place, for example, but reaching through the access opening 15 of the cover assembly 10 to attach the leaf springs 234 with portions of the springs extending underneath the vault.

In restraint mode, the vault panel assemblies 100, 200 may function as a relief valve by moving vertically out of, or becoming unseated from, the vault panel receiving surface 114, 214 to allow the escape of fluid from the vault 111, 211 through the vault opening 112, 212. In this mode, the retention elements 120, 220 are positioned so that the retention legs 132 or ends 232 of the spring 234 extend radially into the vault 111, 211 past the peripheral edge 108, 208 of the panel 102, 202. Similarly, the cover assembly 10 may be positioned in the restraint mode described herein above for the cover assembly 10.

In response to a lower threshold pressure increase 150, 250 within the vault 111, 211, the cover 12 may function as a vent allowing the escape of fluid from the vault 111, 211 through the access opening 15 to the ambient air outside the vault. If a higher threshold pressure increase 160, 260 is initially met, both the cover 12 and the panel 102, 202 may function as vents allowing the escape of fluid from the vault 111, 211 through both the access opening 15 and the vault opening 112, 212. Alternatively, provided the lower threshold pressure increase 150, 250 has occurred and the cover assembly 10 is venting fluid from the vault 111, 211 and, subsequently, the higher threshold pressure increase 160, 260 is met, the vault panel 201, 202 may become unseated from the vault panel receiving surface 114, 214 and function as an additional, or auxiliary vent.

During the escape of fluid from inside the vault 111, 211 both the cover 12 and the vault panel 102, 202 are retained on the frame 14 and the vault, respectively. Once the pressure inside the vault 111, 211 approaches equalization with the ambient pressure both the cover 12 and the vault panel 102, 202 may be reseated on the frame 14 and vault panel receiving surface 114, 214, respectively.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The invention claimed is:

1. A controlled pressure relief vault panel capable of moving to an unseated position from a seated position with respect to a vault opening to relieve pressure, the vault opening having a vault panel receiving surface and peripheral wall, the vault panel comprising:

a vault panel inner surface, outer surface opposing said inner surface, and a vault panel peripheral edge;

at least one projection with a first end affixed to said vault panel inner surface and a second end including a retention assembly defining a length therebetween, said retention assembly including at least one component extending past said vault panel peripheral edge and into the vault such that in response to increased pressure, the panel has a panel range of movement outwardly from the vault to allow the escape of fluids through the vault opening, the panel range of movement defined by characteristics of said retention assembly;

an access opening extending from said vault panel inner surface through said vault panel outer surface and defining a cover frame; and a cover adapted to move from a cover seated position to a cover unseated position with respect to said cover frame.

2. The vault panel of claim 1 wherein said cover moves to said cover unseated position upon an increase in pressure that is lower than the increase pressure required to move the vault panel to the vault panel unseated position.

3. The vault panel of claim 1 further comprising:

said cover frame having a peripheral cover wall defining said access opening, said peripheral cover wall including a cover receiving flange, said cover having a cover upper face, a cover underside opposing the cover upper face;

a first cover leg extending through the access opening, said first cover leg including an upper end and a lower end and defining a length therebetween, wherein said upper end includes a lug and said lower end includes a foot extending outwardly from said first cover leg and underneath a portion of said frame, wherein said first cover leg is slidably movable with said access opening to a closed position wherein said lug engages said cover and said foot is spaced at a vertical distance below said underside of said cover with said foot extending radially outwardly underneath the frame such that in response to increased pressure a first portion of said cover has a cover range of movement with respect to the cover receiving flange that is capable of providing a vertical clearance between said first portion of said cover and said frame to enable the escape of fluids through the access opening, wherein said foot contacts the frame at a limit of said cover range of movement to prevent said first portion of said cover from moving beyond said limit of said cover range of movement; and a second cover leg extending from said underside of said cover, said second cover leg spaced from said first cover leg, said second cover leg including an upper end and a lower end defining a length therebetween, said upper end affixed to said underside of said cover and said lower end including a foot extending outwardly from said second cover leg and underneath a portion of said frame, said length of said second cover leg being shorter than said length of said first cover leg to prevent a second portion of said cover from vertically clearing said frame and causing said cover to open at an angle with respect to said frame in response to movement of said first portion of said cover with said cover range of movement.

4. The vault panel of claim 3 wherein said first cover leg and said second cover leg are diametrically opposed on said cover.

5. The vault panel of claim 4 wherein a portion of said foot on said second cover leg engages the frame when said first cover leg is in said closed position.

6. The vault panel of claim 5 wherein said foot of said second cover leg rotates about a portion of the frame when said first portion of said cover moves within said cover range of movement.

7. The vault panel of claim 6 wherein said length of said first cover leg is at least four times greater than said length of said second cover leg.

8. A controlled pressure relief vault panel capable of moving to an unseated position from a seated position with respect to a vault opening to relieve pressure, the vault opening having a vault panel receiving surface and peripheral wall, the vault panel comprising:

a vault panel inner surface, outer surface opposing said inner surface, and a vault panel peripheral edge;

at least one projection with a first end affixed to said vault panel inner surface and a second end including a retention assembly defining a length therebetween, said retention assembly including at least one retainer leg extending perpendicularly to said projection, a spring associated with said projection and positioned on said projection relative to said retainer leg;

wherein, in an active position, said retainer leg extends radially past said vault panel peripheral edge and beneath the vault such that in response to increased pressure, the panel has a panel range of vertical movement outwardly from the vault to allow the escape of fluids through the vault opening; and an access opening in the vault panel extending from said vault panel inner surface through said vault panel outer surface and defining a cover frame; and a cover adapted to move from a cover seated position to a cover unseated position with respect to said cover frame.

9. The vault panel of claim 8 wherein said spring is a coil spring radially associated with said projection and distally positioned on said projection and wherein said coil spring is positioned between said projection and a bushing located at or near said second end of said projection.

10. The vault panel of claim 8 wherein said panel range of movement is defined by the said length of said projection and characteristics of said coil spring.

11. The vault panel of claim 8 wherein said retainer leg is rotatable about said projection.

12. The vault panel of claim 11 wherein said retainer leg is Y-shaped having 3 legs.

13. The vault panel of claim 12 wherein said Y-shaped retainer is capable of rotating between an installation position wherein the panel is seated into the vault the panel receiving surface and said active position.

14. The panel of claim 8 wherein in response to a first range of increased pressure, said cover moves from said cover seated position to said cover unseated position to vent fluid from the vault, wherein in response to a second range of increased pressure, the panel moves from the seated position to the unseated position and the cover moves from said cover seated position to said cover unseated position, and wherein said second range of increased pressure is higher than said first range of increased pressure.

15. A controlled pressure relief vault panel capable of moving to an unseated position from a seated position with respect to a vault opening to relieve pressure, the vault opening having a vault panel receiving surface and peripheral wall, the vault panel comprising:

a vault panel inner surface, outer surface opposing said inner surface, and a vault panel peripheral edge;

at least one projection with a first end affixed to said vault panel inner surface and a second end including a retention assembly defining a length therebetween, said retention assembly including a spring having a first end and a second end opposing the first end, said spring affixed to said projection at or near said second end of said projection;

wherein said first and second ends of said spring each extend radially past said vault panel peripheral edge and beneath the vault such that in response to increased pressure, the vault panel has a vault panel range of vertical movement outwardly from the vault to allow the escape of fluids through the vault opening; and an access opening in the panel extending from said vault panel inner surface through said vault panel outer surface and defining a cover frame; and a cover positioned within and covering said access opening.

16. The vault panel of claim 15 wherein said spring is a leaf spring having a preformed curved.

17. The vault panel of claim 15 wherein said spring is a flat leaf spring and includes a tension spacer at each end.

18. The vault panel of claim 15 wherein said range of movement of the vault panel is between the seated position of the panel and a fully open panel position in the presence of said increased pressure, wherein, in the fully open panel position, the vault panel is unseated with respect to the vault panel receiving surface, said spring ends contact an interior surface of the vault, and said spring is deformed.

19. The vault panel of claim 15 wherein said cover is adapted to move from a cover seated position to a cover unseated position, wherein in response to a first range of increased pressure, said cover moves from said cover seated position to said cover unseated position to vent fluid from the vault, wherein in response to a second range of increased pressure, the vault panel moves from the seated position to the unseated position and the cover moves from said cover seated position to said cover unseated position, and wherein said second range of increased pressure is higher than said first range of increased pressure.

20. The panel of claim 15 including a spring positioned between said projection and said retention assembly.

* * * * *